United States Patent [19]

Milianowicz et al.

[11] Patent Number: 4,743,876

[45] Date of Patent: May 10, 1988

[54] CIRCUIT INTERRUPTER WITH UNDERVOLTAGE TRIP MECHANISM

[75] Inventors: Stanislaw A. Milianowicz, Monroeville; Charles K. Wallace, Penn Hills Township, Allegheny County, both of Pa.

[73] Assignee: Westinghouse Electric Corp., Pittsburgh, Pa.

[21] Appl. No.: 77,254

[22] Filed: Jul. 24, 1987

[51] Int. Cl.[4] ..... H01H 83/17; H01H 73/00

[52] U.S. Cl. ..... 335/20; 337/173

[58] Field of Search ..... 335/20, 6, 173, 28

[56] References Cited

U.S. PATENT DOCUMENTS

| | | | |
|---|---|---|---|
| 3,533,024 | 10/1970 | Heintz | 335/20 |
| 3,590,192 | 6/1971 | Bould | 200/153 |
| 3,689,721 | 7/1972 | McGuffie | 200/153 |
| 3,750,059 | 7/1973 | Patel | 335/142 |
| 3,760,307 | 9/1973 | Patel | 335/13 |

*Primary Examiner*—H. Broome

*Attorney, Agent, or Firm*—L. P. Johns

[57] ABSTRACT

A circuit breaker characterized by a voltage-responsive device having an electromagnet including an armature. A linkage connects the armature to the trip latch of the circuit breaker in order to open the circuit breaker contacts when a voltage occurs that is less than a predetermined voltage value. Under normal operating conditions, when the contacts are closed, the armature is retained in place by an electromagnetic force, but is biased away therefrom when the voltage drops below that voltage value.

7 Claims, 6 Drawing Sheets

CIRCUIT INTERRUPTER WITH UNDERVOLTAGE TRIP MECHANISM

BACKGROUND OF THE INVENTION

1. Field of the Invention

This invention relates to an electric circuit breaker and, more particularly, it pertains to an undervoltage trip mechanism in response to a voltage drop below a predetermined value on a power line.

2. Description of the Prior Art

Medium voltage switchgear has usually employed operating mechanisms that have a trip mechanism for separating a pair of electrical contacts. Such mechanisms have provided protection for an electrical circuit or system against electrical faults, such as overload conditions, load level short circuit, or fault current conditions, as well as high level short circuit conditions. In addition, prior art circuit breakers have utilized mechanisms for detecting undervoltage conditions and, for tripping circuit breakers upon the occurrence of undervoltage conditions, such as disclosed in U.S. Pat. Nos. 3,533,024 and 4,620,171.

Most undervoltage trip devices have offered high technology contrivances by virtue of the complexities of design as well as by various delicate assembly procedures. This invariably means that the cost of the device is high while functional reliability, if not low, is dependent upon frequent routine maintenance.

SUMMARY OF THE INVENTION

It has been found, in accordance with this invention, that the foregoing problems may be overcome by a circuit breaker for interrupting current through a power line when voltage on the line drops below a predetermined value, comprising a pair of separable contacts movable between open and closed positions; a circuit breaker operating mechanism including an operating shaft rotatable between open and closed positions of the contacts; a crankshaft for actuating said mechanism and movable between open and closed positions of the contacts; opening spring means coupled with the crankshaft for opening the contacts; a first trip latch for releasably latching said mechanism in the closed position; an undervoltage linkage connected to the trip latch; voltage-responsive means for retaining the linkage in the contact-closed position so long as the voltage on the power line remains above a predetermined value and including an armature; biasing means biasing the armature in a direction to cause release of the first trip latch; a second linkage extending between the operating shaft and the armature for closing the armature when the contacts are in the open position; the trip latch including a rotatable trip shaft and lever fixedly mounted thereon, the undervoltage linkage including a link extending between the armature and the lever; the second linkage closing the armature against the biasing means when the contacts are in the open position; a second trip latch connected to the lever for rotating the lever to the trip position; the second trip latch including a trip lever operable manually and/or by a shunt trip coil; the voltage-responsive means including a coil and a core assembly operable with the armature; and the biasing spring means exerting a force on the armature that is less than the electromagnetic force exerted by the coil and core assembly.

The advantage of the device of this invention is that most of the parts are simple stampings made from 0.125 mild steel. There are no friction-dependent mechanical functions in the device. Moreover, there are no mechanical latches; rather, the tension in the spring that provides the trip force is maintained by direct action of the electromagnet on the device.

DESCRIPTION OF THE PREFERRED EMBODIMENT

Figure 1:
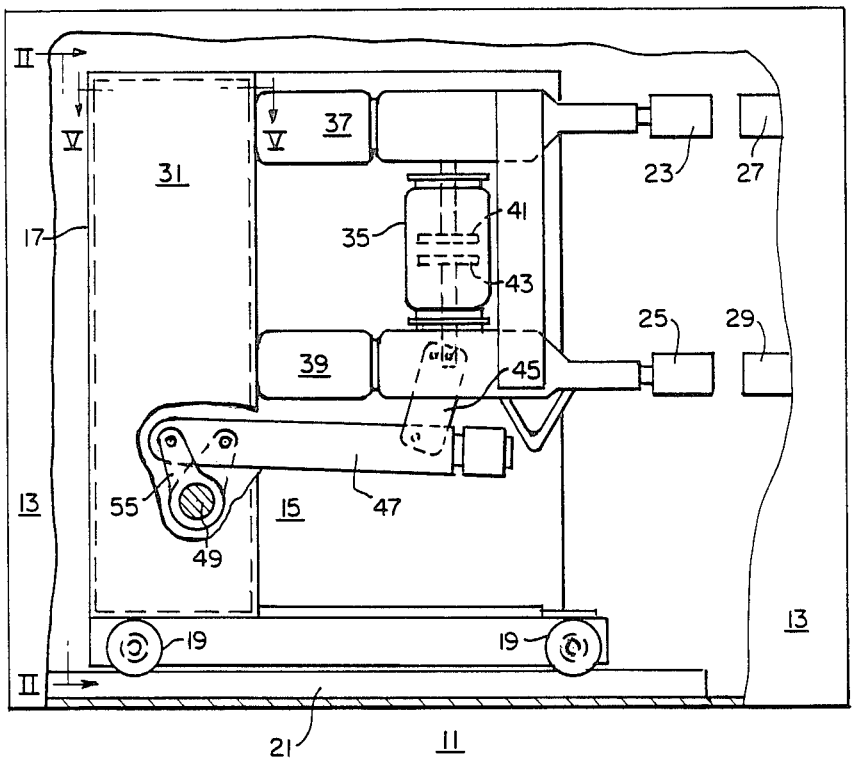
FIG. 1 is a side elevational view of the drawout circuit breaker of this invention in a disconnected position.
Figure 2:
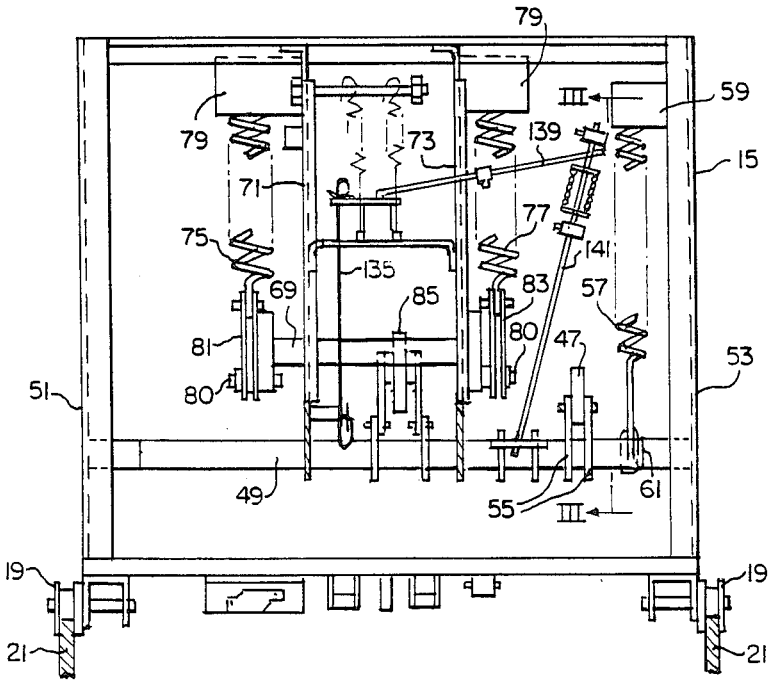
FIG. 2 is a front elevation of the drawout circuit breaker taken on the line II—II of FIG. 1.

In FIGS. 1 and 2 a metal-clad or metal-enclosed switchgear apparatus is generally indicated at 11 and includes a metal cabinet or enclosure 13 for enclosing a drawout vacuum circuit breaker 15. The circuit interrupter 15 is preferably a drawout three-phase vacuum circuit interrupter and may have controls on a front panel 17 for manually operating the circuit breaker. The circuit breaker 15 is movably disposed on wheels 19 on rails 21 into and out of the enclosure 13. In that manner, terminals 23, 25 on the circuit breaker 15 are moved into and out of contact with corresponding terminals 27, 29 within the enclosure 13.

The circuit breaker 15 preferably embodies a three-phase interrupter apparatus having a front low voltage portion 31 adjacent to the front panel 17 and a rear high voltage portion including a vacuum circuit interrupter 35. The high and low voltage portions are electrically insulated from each other by upper and lower insulators 37, 39. Within each vacuum interrupter 35 a pair of separable contacts including a stationary contact 41 and movable contact 43 are provided. The contacts are operated between open and closed electrical circuit condition by a linkage 45 which includes an insulating link 47 which extends between the low voltage portion 31 and the movable contact 43.

The operating parts for opening and closing the contacts 41, 43 are contained within the front low voltage portion 31 as shown in FIGS. 2–9. In FIG. 2 an operating shaft 49 is rotatably mounted in opposite sidewalls 51, 53. The shaft, when rotated, opens and closes the contacts 41, 43 in the three phases of the switchgear apparatus 11, only one of which phases is shown. For that purpose the insulating link 47 is connected by a pair of arms 55 which are fixedly mounted on the shaft 49. An opening spring 57 extends from a frame member 59 to the operating shaft 49 where it is connected by an arm 61 which extends into the sheet of the drawing and which is fixedly mounted on the shaft 49. The spring 57 rotates the shaft 49 counterclockwise when opening the contacts through the insulating link 47.

A crankshaft 69 (FIG. 2) is rotatably supported between a pair of spaced supports 71, 73. A pair of closing springs 75, 77 depend from similar frame portions 79 and have lower ends attached by pins 80 to similar rotatable cranks 81, 83 which are fixedly mounted on the crankshaft 69 (FIG. 3).

A cam 85 (FIG. 2) is likewise fixedly mounted on the crankshaft 69 and includes a notch 87 in the peripheral cam surface thereof (FIGS. 6–9). A linkage mechanism is provided in conjunction with the cam 85 for closing the contacts 41, 43, which mechanism (FIGS. 3,4) includes an arm 89, a link 91, a roller 93, a link 95, and a trip latch 97. The arm 89 is fixedly mounted on the operating shaft 49 and is pivotally mounted at 99 to the link 91. The link 91 is a channel-shaped member for supporting the roller 93 on a pin 101 extending between opposite sides of the link 91. The link 95 is pivotably mounted by pin 103 to the trip latch 97, which is a lever pivotably mounted at pin 105. A trip shaft 107 includes a notch 109 and functions in conjunction with an end 111 of the trip latch 97 is in long as the shaft 107 is in the position shown in FIGS. 7, 8, 9, the trip mechanism including the trip latch 97. So the untripped position with the end 111 on the surface of the trip shaft 107.

Figure 6:
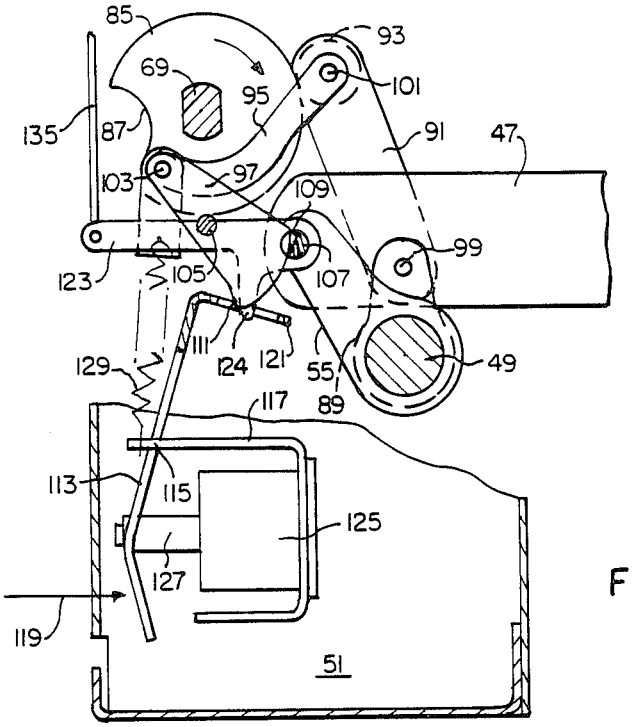
FIG. 6 is an enlarged fragmentary sectional view of an operating mechanism, showing the breaker in the open position and a closing spring not charged.

When the trip shaft 107 is rotated clockwise to the position shown in FIG. 6, trip latch 97 rotates about the pin 105 to that position. Rotation of the trip latch 97 enables the link 95 to move to the position shown (FIG. 6), whereby the link 91 is raised, with the roller 93 riding over the cam 85, thereby allowing operating shaft 49 and arm 89 to rotate. Thus, the insulating link 47 moves to the open position of the breaker.

Figure 3:
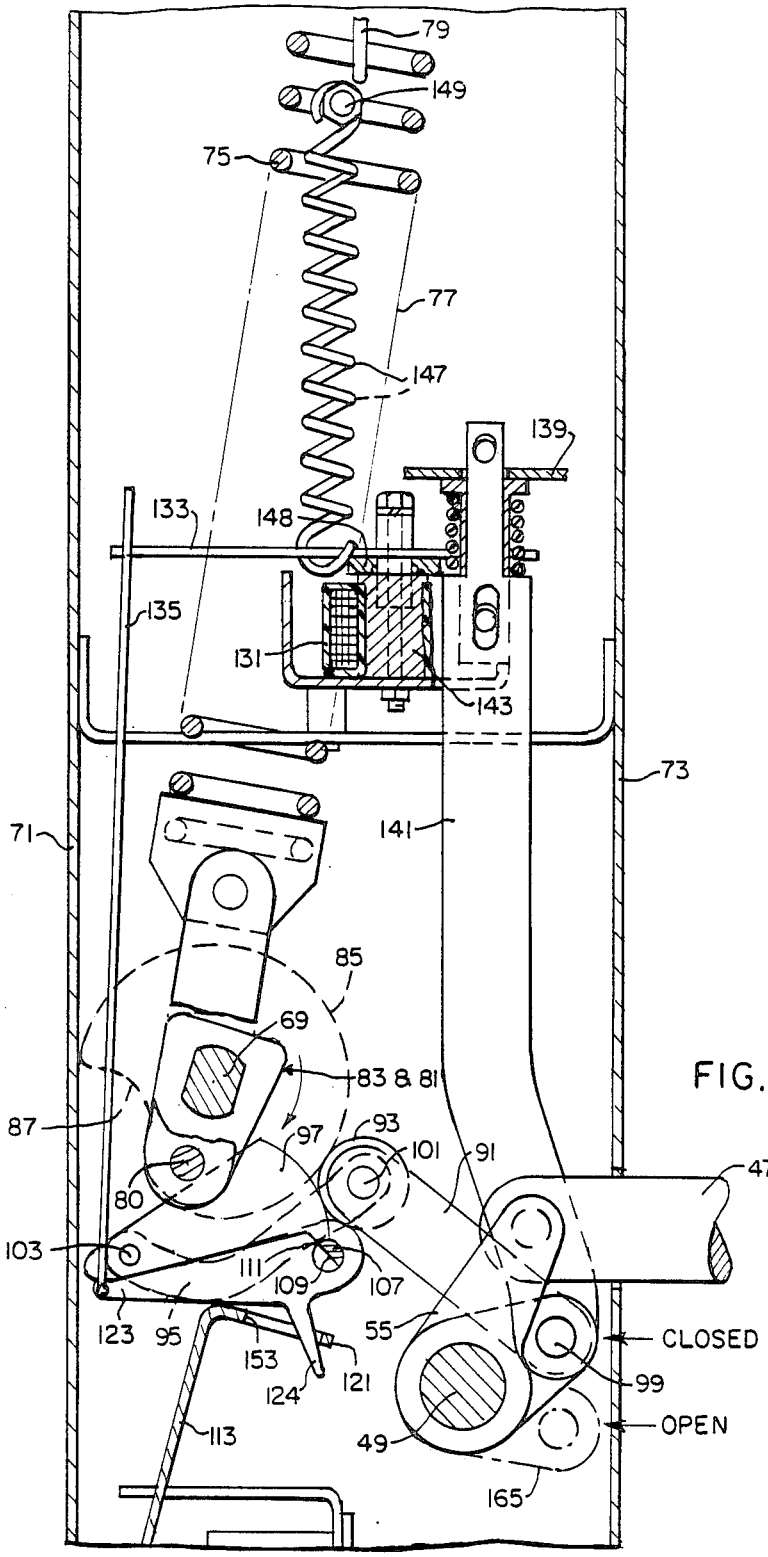
FIG. 3 is a vertical sectional view taken on the line III—III of FIG. 2.

The manner in which the springs 75, 77 are charged, such as shown in FIG. 3, is well known in the art and is accomplished either manually or by electric motor, such as described in greater detail in U.S. Pat. No. 3,590,192, as well as in U.S. Pat. No. 3,750,059, which patents disclose charging means including a pawl and ratchet.

Figure 7:
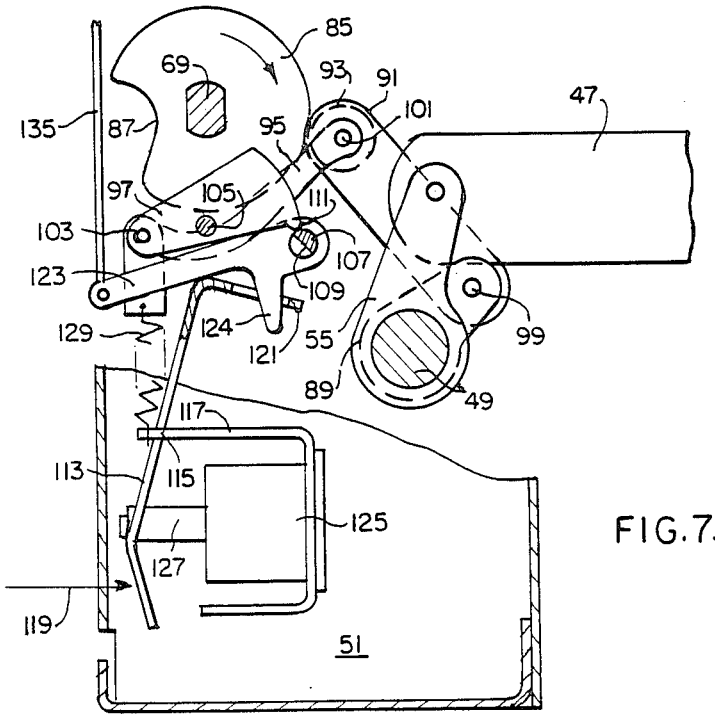
FIG. 7 is an enlarged fragmentary sectional view of the operating mechanism with the breaker in the closed position and the closing spring not charged.
Figure 8:
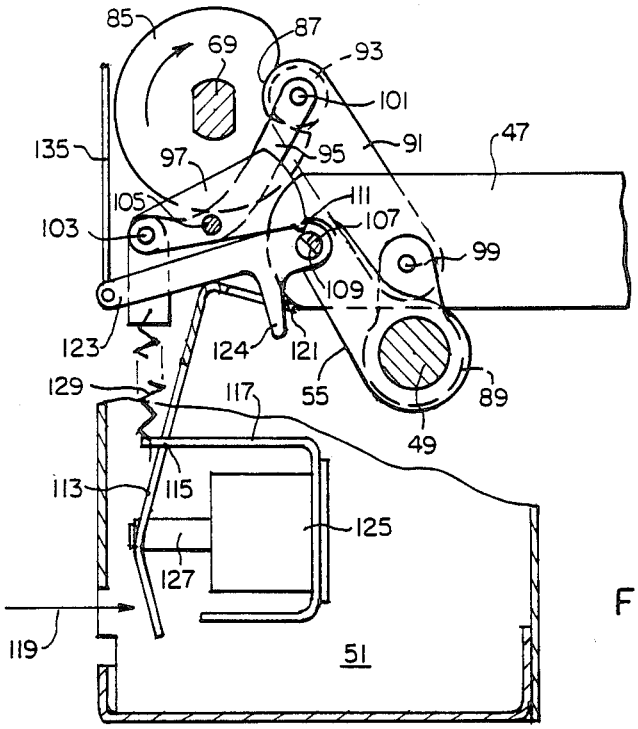
FIG. 8 is an enlarged fragmentary sectional view of the operating mechanism with the breaker open and the closing spring charged.
Figure 9:
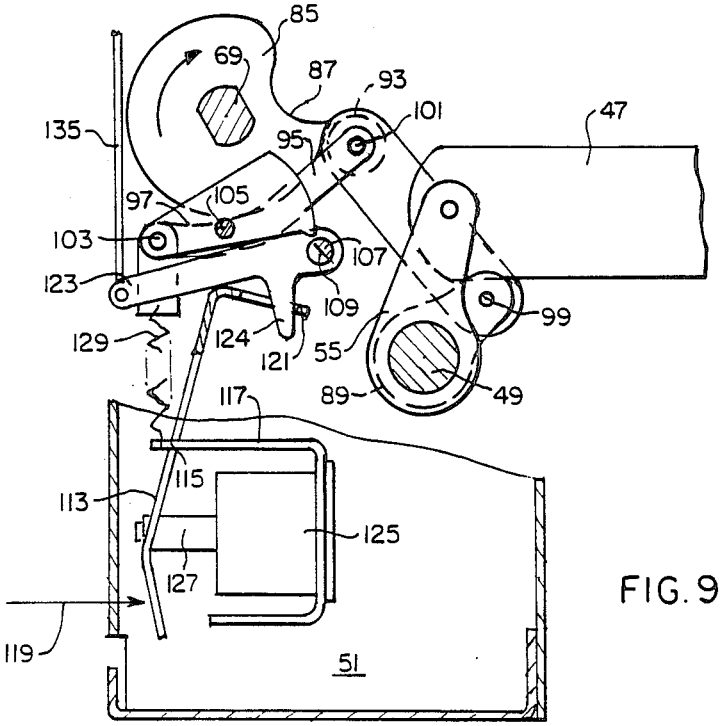
FIG. 9 is an enlarged fragmentary section view of the operating mechanism with the breaker in the closed position and the closing springs charged.

The cycles of operation of the charge spring and condition of the contacts 41, 43 are shown in FIGS. 6–9. In FIG. 6 the breaker is open and the closing springs 75, 77 are not charged. In FIG. 7 the contacts 41, 43 are closed and the springs are not charged. In FIG. 8 the contacts 41, 43 are open and the opening springs are charged. In FIG. 9 the contacts 41, 43 are closed and the springs are charged.

Tripping of the circuit breaker to open the contacts 41, 43 has in the past occurred in a number of ways including a lever 113 (FIGS. 6–9), which lever is pivotably mounted at 115 on a U-shaped bracket 117. When the lower end of the lever is moved manually in the direction of the arrow 119, the lever rotates counterclockwise and an upper end 121 of the lever rotates an arm 124 of a lever 123 clockwise. The lever 123 is fixedly mounted on the trip shaft 107 which is thereby rotated clockwise, causing the end 111 of the trip latch 97 to rotate through the notch 109 of the shaft 107.

The circuit breaker is tripped is by means of a coil 125 having a plunger 127, the latter of which is attached to the lower end of the lever 113. The circuit breaker is tripped by remote control of the coil 125 to rotate the lever 113.

A spring 129 extends between the end of the bracket 117 and the trip latch 97 for rotating the latch counterclockwise and thereby return it from the tripped position (FIG. 6) to the untripped position (FIG. 7). The foregoing is well known in the circuit breaker art.

Figure 4:
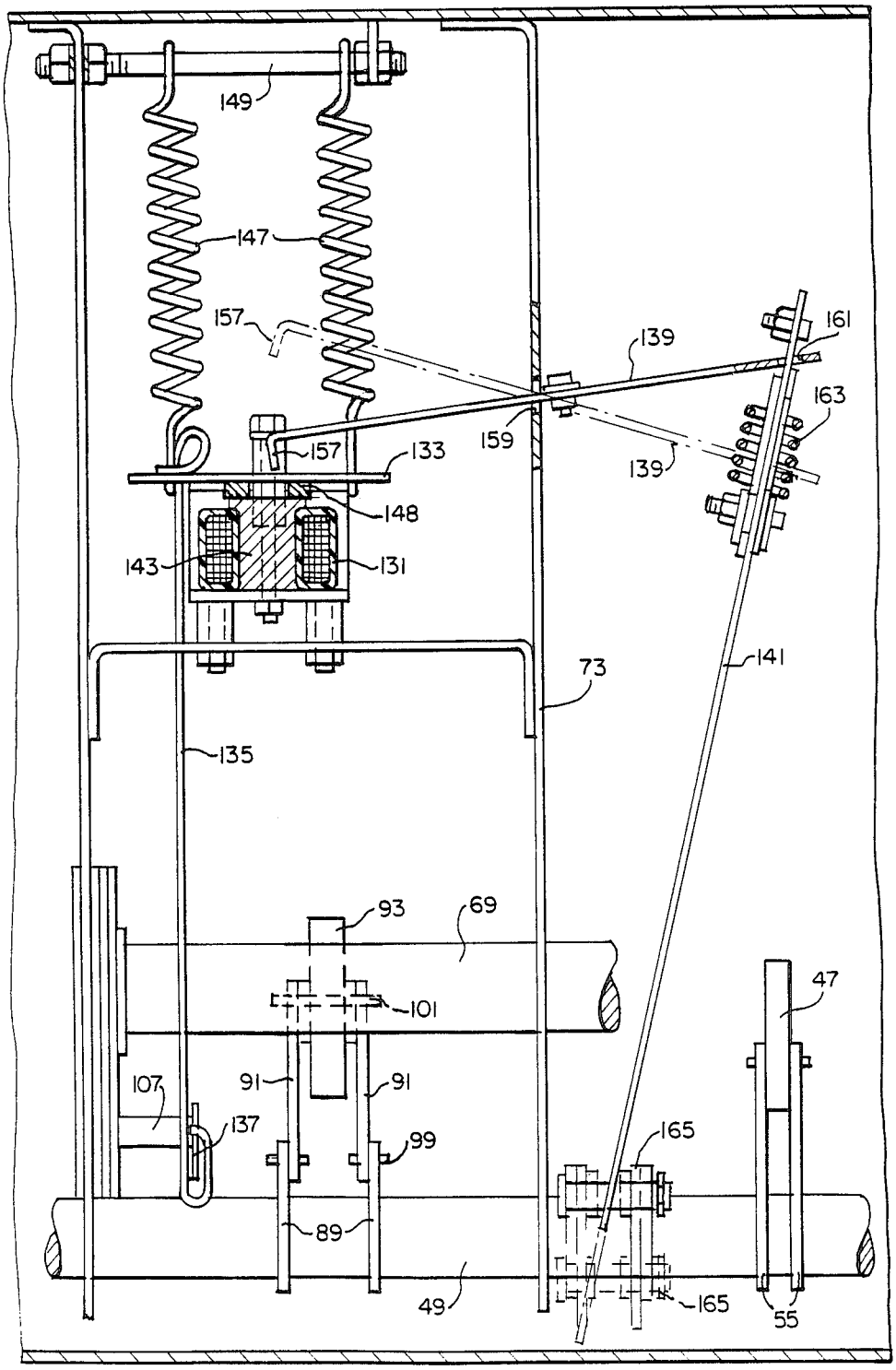
FIG. 4 is an enlarged fragmentary vertical view of a structure shown in FIG. 2.
Figure 5:
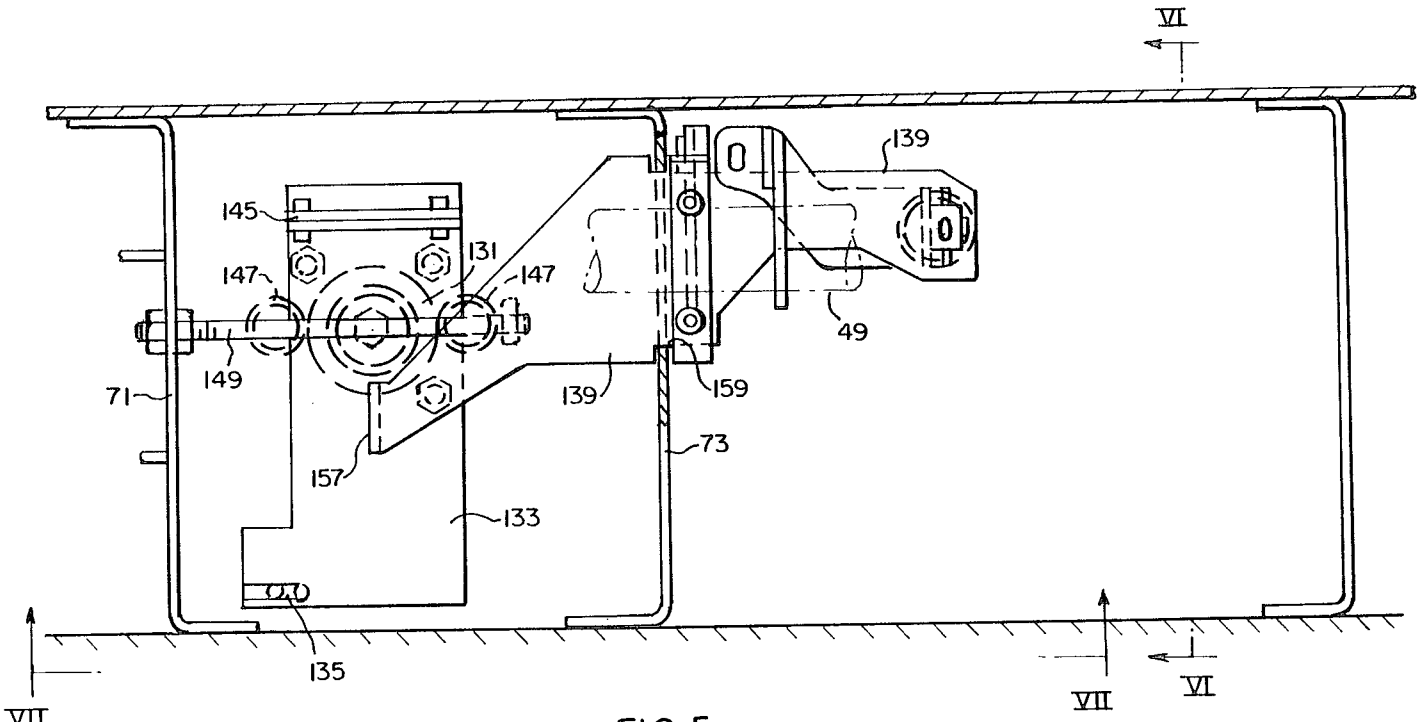
FIG. 5 is a horizontal sectional view taken on the line V—V of FIG. 1.

In accordance with this invention, an additional trip means is provided when an undervoltage occurs through the contacts 41, 43 in the system which is protected by a circuit breaker which includes the undervoltage trip mechanism in order to avoid any detrimental effects of undervoltage in the system. The undervoltage trip mechanism includes an electromagnetic coil 131 (FIGS. 3, 4, 5) including an armature 133, an elongated rod 135, and the lever 123 (FIG. 6). The mechanism also includes a lever 139 and a link 141 for resetting the armature 133. The electromagnetic coil 131 which is connected to controls includes a core 143 for holding the armature 133 in place as shown in FIGS. 3, 4. The armature 133 is pivotably mounted at 145 (FIG. 5) and a pair of coil springs 147 are secured thereto. The upper ends of the springs 147 are secured to a bolt 149 which is fixedly mounted in place. When the voltage to coil is within a predetermined range, the electromagnetic force holding the armature 133 in place is sufficient to overcome the force of the springs 147. However, when an undervoltage occurs in the coil 133, the springs 147 pull the armature upwardly about the pivot 145, thereby raising the rod 135 and rotating the lever 123 clockwise to thereby rotate the trip shaft 107.

As shown in FIG. 4, a non-magnetic washer 148, such as copper or aluminum, is disposed between the core 143 and the armature 133 for establishing a gap therebetween and for regulating the value of the voltage at which the breaker trips. Thus, the thicker the washer the lower the voltage at which the armature 133 will be able to move under the action of force supplied by springs 147. When the armature 133 rises from the core, it pulls up the rod 135 which pulls on the lever 137 which rotates the shaft 107. This action constitutes the undervoltage trip.

The link 141 enables resetting of the armature. When the shaft 49 is rotated during the breaker opening action, the link 141 rises to rotate the lever 139 counterclockwise, whereby the portion 157 of the lever rotates the armature downwardly to the position shown in FIG. 4.

In conclusion, the device of this invention provides a simplistic electro-mechanical means for tripping the circuit breaker in response to an undervoltage occurrence. The cost of the mechanism is low because it includes no critical setting dimensions and the parts may be provided with glide tolerances.

Also it is noted that all ferromagnetic parts which make up the magnetic flux containing parts of this device are made from 0.125 mild steel rather than from comparatively expensive stacks of steel laminations as in some other devices of this kind.

What is claimed is:

1. A circuit breaker for interrupting current through a power line when voltage on the line drops below a predetermined value, comprising:

(1) a pair of separate contacts movable between open and closed positions;

(2) a circuit breaker operating mechanism including an operating shaft rotatable between open and closed positions of the contact; and (3) a crankshaft for actuating said mechanism and movable between open and closed positions of the contacts;
(4) opening spring means coupled with the crankshaft for opening the contacts;
(5) a first trip latch for releasably latching said mechanism in the closed position;
(6) an undervoltage linkage connected to the trip latch;
(7) voltage-responsive means for retaining the linkage in the contact-closed position so long as the voltage on the power line remains above a predetermined value and including an armature;
(8) biasing means biasing the armature in a direction to cause release of the trip latch; and
(9) a second linkage extending between the operating shaft and the armature for closing the armature when the contacts are in the open position.

2. The circuit breaker of claim 1 in which the trip latch includes a rotatable trip shaft and lever fixedly mounted thereon and the undervoltage linkage including a link extending between the armature and the lever.

3. The circuit breaker of claim 2 in which the second linkage closes the armature against the biasing means when the contacts are in the open position.

4. The circuit breaker of claim 2 in which a second trip latch is connected to the lever for rotating the lever to the trip position.

5. The circuit breaker of claim 3 in which the second trip latch includes a trip lever operable manually and/or by a shunt trip coil.

6. The circuit breaker of claim 1 in which the voltage-responsive means includes a coil and core assembly operable with the armature.

7. The circuit breaker of claim 6 in which the biasing spring means exerts a force on the armature that is less than the electromagnetic force exerted by the coil and core assembly.

* * * * *